US011370092B2

(12) United States Patent
Hung

(10) Patent No.: US 11,370,092 B2
(45) Date of Patent: Jun. 28, 2022

(54) TORQUE CONNECTOR STRUCTURE

(71) Applicant: Chien-Wei Hung, Taichung (TW)

(72) Inventor: Chien-Wei Hung, Taichung (TW)

( * ) Notice: Subject to any disclaimer, the term of this patent is extended or adjusted under 35 U.S.C. 154(b) by 21 days.

(21) Appl. No.: 16/943,116

(22) Filed: Jul. 30, 2020

(65) Prior Publication Data

US 2022/0032428 A1 Feb. 3, 2022

(51) Int. Cl.
*B25B 23/14* (2006.01)
*B25B 23/142* (2006.01)
*B25B 15/02* (2006.01)

(52) U.S. Cl.
CPC ..... *B25B 23/141* (2013.01); *B25B 23/1427* (2013.01); *B25B 15/02* (2013.01)

(58) Field of Classification Search
CPC ..... B25B 23/1427
See application file for complete search history.

(56) References Cited

U.S. PATENT DOCUMENTS 3,942,337 A 3/1976 Leonard et al.
6,832,533 B1 * 12/2004 Huang ..... B25B 23/1427 81/467
8,808,095 B2 * 8/2014 Cheng ..... F16D 7/044 464/23
2014/0352502 A1 * 12/2014 Lai ..... B25B 15/02 81/475
2015/0273670 A1 * 10/2015 Cheng ..... B25B 13/06 81/121.1

* cited by examiner

*Primary Examiner* — David B. Thomas
*Assistant Examiner* — Jonathan G Santiago Martinez
(74) *Attorney, Agent, or Firm* — Karin L. Williams; Alan D. Kamrath; Mayer & Williams PC

(57) ABSTRACT

A torque connector structure includes a first body, a second body assembled with the first body, a first drive member assembled with the first body, a second drive member received in the first body and having a plurality of first receiving grooves each having a cylindrical shape, a third drive member received in the first body and the second body, a fourth drive member mounted on the third drive member and having a plurality of second receiving grooves, an elastic member biased between the first drive member and the second drive member, and a plurality of pins received between the first receiving grooves and the second receiving grooves. The second drive member and the first drive member are driven simultaneously.

17 Claims, 12 Drawing Sheets

TORQUE CONNECTOR STRUCTURE

BACKGROUND OF THE INVENTION

1. Field of the Invention

The present invention relates to a hand tool and, more particularly, to a torque connector structure.

2. Description of the Related Art

A conventional torque structure was disclosed in the U.S. Pat. No. 3,942,337, and comprises an inner cylinder (or a first cup shaped section) 1, an outer cylinder (or a second cup shaped section) 2, a first connecting block (or first socket engaging stud) 3, a second connecting block (or second socket engaging stud) 4, multiple balls (or bearings) 7, a positioning member, an elastic member, and a plurality of washers 10. The inner cylinder 1 has a periphery provided with an external thread and an indication line and has a center provided with a through hole. The outer cylinder 2 is mounted on the inner cylinder 1 and is provided with an internal thread screwed onto and rotated relative to the external thread of the inner cylinder 1. The outer cylinder 2 has a periphery provided with an annularly arranged scale corresponding to the indication line of the inner cylinder 1. The outer cylinder 2 has a center provided with a through hole. The inner cylinder 1 and the outer cylinder 2 are assembled to define a receiving space. The first connecting block 3 is pivotally mounted in the receiving space. The first connecting block 3 has a first end provided with a first engaging portion and a second end provided with a first mounting portion. The first mounting portion protrudes from the through hole of the inner cylinder 1. The second connecting block 4 is pivotally mounted in the receiving space. The second connecting block 4 has a first end provided with a second engaging portion and a second end provided with a second mounting portion. The second engaging portion engages the first engaging portion. The second mounting portion protrudes from the through hole of the outer cylinder 2. The second mounting portion is a hexagonal recess mounted on a wrench. The balls 7 are mounted between the first engaging portion of the first connecting block 3 and the second engaging portion of the second connecting block 4. When the second connecting block 4 is driven, the balls 7 and the first connecting block 3 are driven and rotated. The elastic member is biased between the outer cylinder 2 and the second connecting block 4.

In operation, the outer cylinder 2 is rotated to adjust the relative position between the inner cylinder 1 and the outer cylinder 2, so as to adjust the compression degree of the elastic member, and to set the rotation torque of the conventional torque structure. When the second connecting block 4 is driven, the balls 7 and the first connecting block 3 are driven and rotated. The first mounting portion is mounted on a socket to rotate a screw member. When the screw member is tightened to a determined degree, the first connecting block 3 is subjected to a resistance. When the axial force applied on the first connecting block 3 and the second connecting block 4 is more than the elastic force of the elastic member, the second connecting block 4 is moved toward the elastic member, to compress the elastic member, such that the second connecting block 4, the first connecting block 3 and the balls 7 are detached. Thus, the second connecting block 4 cannot drive the first connecting block 3.

However, such a conventional torque structure has the following disadvantages.

The balls 7 are arranged to form a ring-shaped structure. The balls 7 are mounted between the first engaging portion of the first connecting block 3 and the second engaging portion of the second connecting block 4. In such a manner, the balls 7 are received in the toothed portions of the first engaging portion and the toothed portions of the second engaging portion. Thus, when the balls 7 are mounted in the toothed portions of the first engaging portion and the toothed portions of the second engaging portion, the balls 7 will roll on the second engaging portion, such that the balls 7 easily drop or fall from the second engaging portion, thereby causing inconvenience in assembly, wasting the working time and energy, and increasing the cost of production.

BRIEF SUMMARY OF THE INVENTION

The primary objective of the present invention is to provide a torque connector structure that is assembled easily and conveniently.

In accordance with the present invention, there is provided a torque connector structure comprising a first body, a second body, a first drive member, a second drive member, a third drive member, a fourth drive member, an elastic member, and a plurality of pins. The first body is provided with a receiving space. The second body is assembled with the first body. The first drive member is assembled with the first body. The second drive member is received in the receiving space. The second drive member is mounted on the first drive member such that the second drive member and the first drive member are driven simultaneously. The second drive member is provided with a plurality of first receiving grooves. Each of the first receiving grooves has a cylindrical shape. The third drive member is received in the receiving space and the second body. The fourth drive member is received in the receiving space and mounted on the third drive member. The fourth drive member is provided with a plurality of second receiving grooves. The elastic member is biased elastically between the first drive member and the second drive member. Each of the pins is received in each of the first receiving grooves and each of the second receiving grooves. Each of the pins has a first end provided with a first received portion and a second end provided with a second received portion. The first received portion has a semicircular shape and is received in each of the second receiving grooves. The second received portion has a cylindrical shape and is received in each of the first receiving grooves.

According to the primary advantage of the present invention, each of the pins is provided with the first received portion and the second received portion. The first received portion is received in or detached from each of the second receiving grooves by the compression degree of the elastic member. The second received portion is received in each of the first receiving grooves. Each of the pins has a cylindrical shape such that each of the pins is received in each of the first receiving grooves and will not drop from the second drive member. Thus, each of the pins is assembled easily.

According to another advantage of the present invention, the second received portion is received in each of the first receiving grooves. When the first mounting portion of the first drive member is driven, the first drive member drives the second drive member, the third drive member, and the fourth drive member. The first received portion of each of the pins is received in each of the second receiving grooves. After the screw member is driven by the fifth mounting portion to reach a determined torque, the axial force applied on the second drive member is more than the elastic force of the elastic member, such that the second drive member is moved backward to further compress the elastic member, and the first received portion of each of the pins is detached from each of the second receiving grooves.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
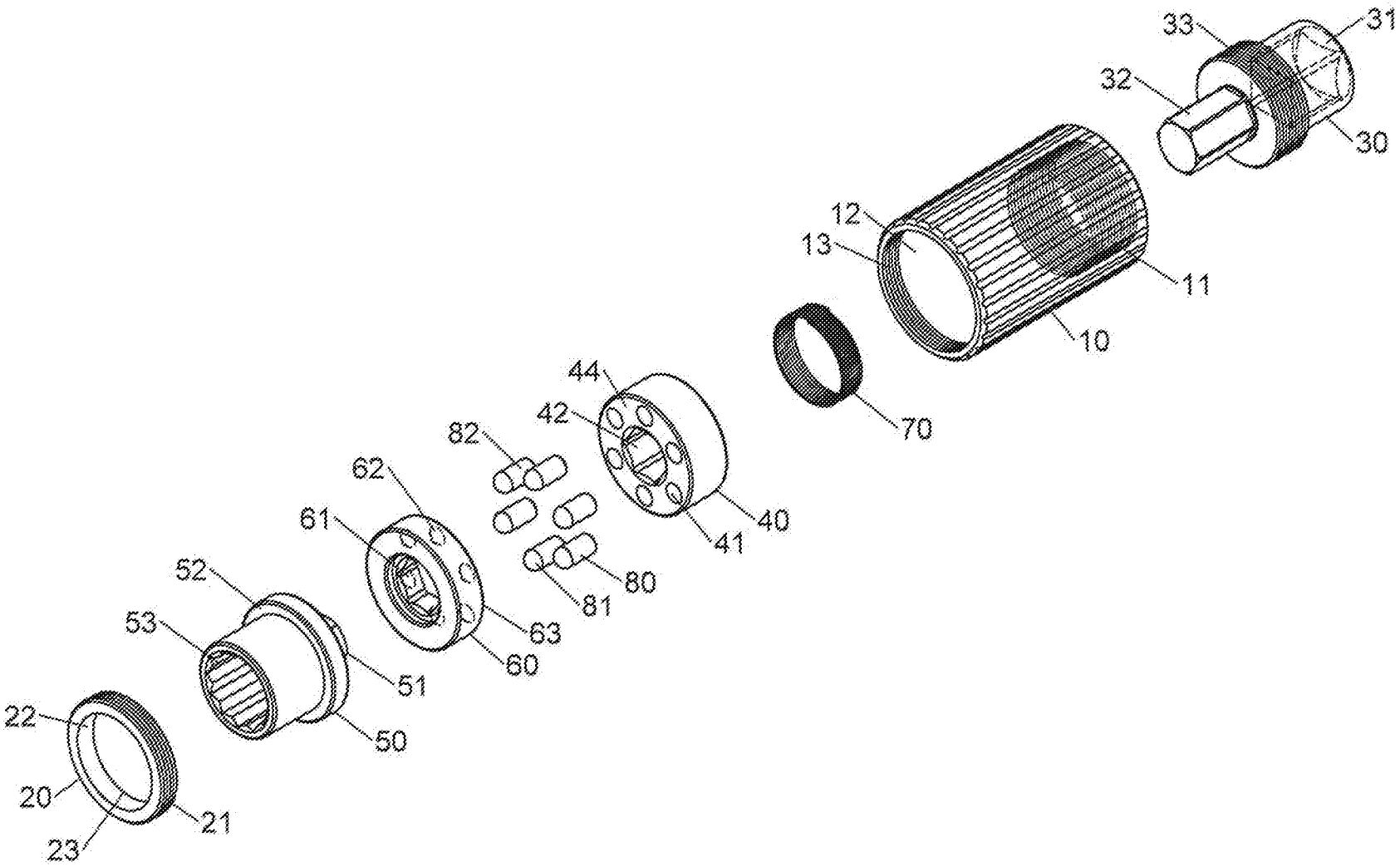
FIG. 1 is an exploded perspective view of a torque connector structure in accordance with the first preferred embodiment of the present invention.

Referring to the drawings and initially to FIGS. 1-4, a torque connector structure in accordance with the preferred embodiment of the present invention comprises a first body 10, a second body 20, a first drive member 30, a second drive member 40, a third drive member 50, a fourth drive member 60, an elastic member 70, and a plurality of pins 80.

The first body 10 has a first end provided with a first threaded portion 11 and a second end provided with a second threaded portion 13. The first threaded portion 11 is an internal thread. The second threaded portion 13 is an internal thread. The second threaded portion 13 and the first threaded portion 11 are distant from each other. The first body 10 is provided with a receiving space 12. The receiving space 12 has a circular shape and extends through the first body 10.

The second body 20 is assembled with the first body 10. The second body 20 is provided with a third threaded portion 21 screwed with the second threaded portion 13 of the first body 10. The third threaded portion 21 is an external thread. The second body 20 is rotated and moved in a range of the second threaded portion 13. The second body 20 is provided with a first through hole 22. The first through hole 22 has a circular shape and extends through the second body 20. The second body 20 has an end face provided with a first resting portion 23 which is directed toward the receiving space 12.

The first drive member 30 is assembled with the first body 10. The first drive member 30 has a first end provided with a first mounting portion 31 and a second end provided with a second mounting portion 32. The first mounting portion 31 protrudes from the first body 10. The second mounting portion 32 and the first mounting portion 31 are distant from each other. The second mounting portion 32 has a noncircular shape and is received in the receiving space 12. The first drive member 30 is provided with a fourth threaded portion 33 screwed with the first threaded portion 11. The fourth threaded portion 33 is an external thread and is located between the first mounting portion 31 and the second mounting portion 32. A relative position between the first drive member 30 and the first body 10 is adjustable in a range of the first threaded portion 11.

The second drive member 40 is received in the receiving space 12. The second drive member 40 is mounted on the first drive member 30 such that the second drive member 40 and the first drive member 30 are integrated and driven simultaneously. A relative position between the second drive member 40 and the first drive member 30 is adjustable. The second drive member 40 is provided with a plurality of first receiving grooves 41 which are arranged annularly. Each of the first receiving grooves 41 has a cylindrical shape. The second drive member 40 is provided with a third mounting portion 42 which extends through the second drive member 40. The third mounting portion 42 is mounted on the second mounting portion 32 which is slidable linearly in the third mounting portion 42. The second drive member 40 is provided with a first end face 44. The first receiving grooves 41 are formed in the first end face 44.

The third drive member 50 is received in the receiving space 12 of the first body 10 and the first through hole 22 of the second body 20. The third drive member 50 has a first end provided with a fourth mounting portion 51 and a second end provided with a fifth mounting portion 53. The fifth mounting portion 53 protrudes from the first through hole 22. The third drive member 50 is provided with a second resting portion 52 abutting the first resting portion 23.

The fourth drive member 60 is received in the receiving space 12 and mounted on the third drive member 50. The fourth drive member 60 is provided with a sixth mounting portion 61 mounted on the fourth mounting portion 51. The fourth drive member 60 is provided with a plurality of second receiving grooves 62 which are arranged annularly. The second receiving grooves 62 align with the first receiving grooves 41. Each of the second receiving grooves 62 has a semicircular shape. The fourth drive member 60 is provided with a second end face 63. The second receiving grooves 62 are formed in the second end face 63. The second end face 63 faces the first end face 44. The second end face 63 is spaced from or not spaced from the first end face 44.

The elastic member 70 is biased elastically between the first drive member 30 and the second drive member 40. The elastic member 70 has a first end pressing the first drive member 30 and a second end pressing the second drive member 40.

Each of the pins 80 is received in each of the first receiving grooves 41 and each of the second receiving grooves 62. Each of the pins 80 has a first end provided with a first received portion 81 and a second end provided with a second received portion 82. The first received portion 81 has a semicircular shape and is received in each of the second receiving grooves 62. The second received portion 82 has a cylindrical shape and is received in each of the first receiving grooves 41.

In the preferred embodiment of the present invention, the first mounting portion 31 is a tetragonal (or square) recess, a hexagonal head or a hexagonal recess, and the fifth mounting portion 53 is a dodecagonal recess, a hexagonal recess, a tetragonal head or a hexagonal head.

In the preferred embodiment of the present invention, the second mounting portion 32 is a hexagonal head, the third mounting portion 42 has a shape the same as that of the second mounting portion 32 and is a hexagonal recess, the fourth mounting portion 51 is a hexagonal head, and the sixth mounting portion 61 is a hexagonal recess.

In the preferred embodiment of the present invention, the second drive member 40 is provided with three, six, nine or twelve first receiving grooves 41.

Figure 2:
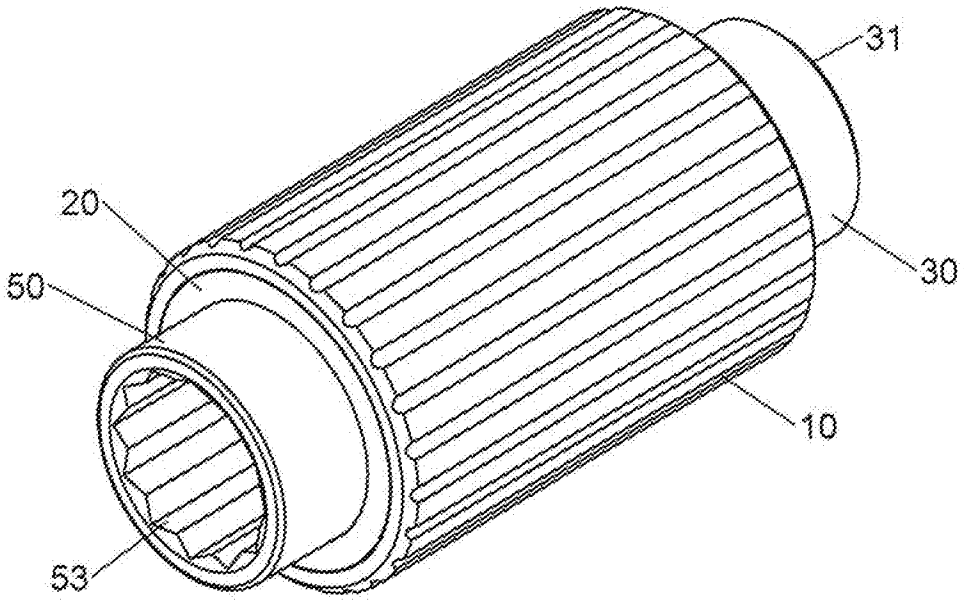
FIG. 2 is a perspective view of the torque connector structure in accordance with the first preferred embodiment of the present invention.
Figure 4:
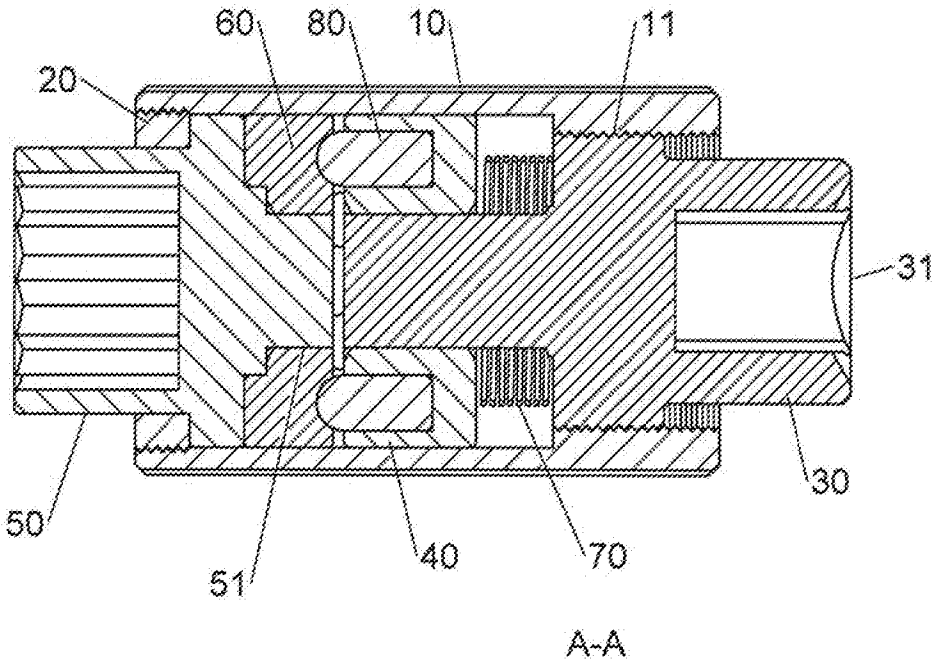
FIG. 4 is a cross-sectional view of the torque connector structure taken along line A-A as shown in FIG. 3.
Figure 3:
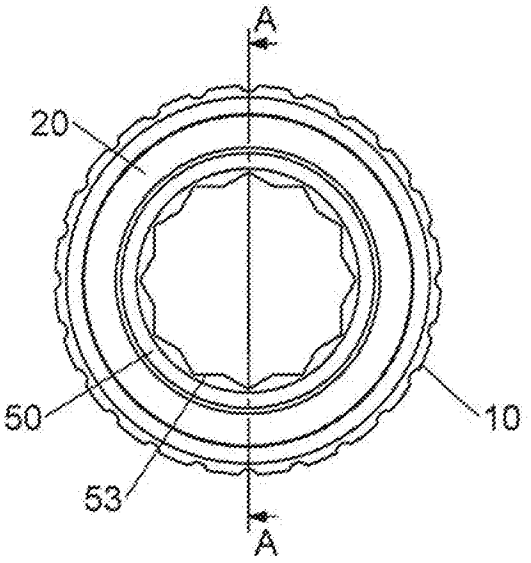
FIG. 3 is a front view of the torque connector structure in accordance with the first preferred embodiment of the present invention.

In short, the third threaded portion 21 of the second body 20 is screwed into the second threaded portion 13 of the first body 10, the fourth threaded portion 33 of the first drive member 30 is screwed into the first threaded portion 11 of the first body 10, the first mounting portion 31 of the first drive member 30 protrudes from the first body 10 as shown in FIG. 2, the third drive member 50 is received in the receiving space 12 of the first body 10 and the first through hole 22 of the second body 20, and the fifth mounting portion 53 of the third drive member 50 protrudes from the first through hole 22 of the second body 20.

Again referring to FIGS. 1-4, the third threaded portion 21 of the second body 20 is screwed into the second threaded portion 13 of the first body 10, such that the second body 20 is assembled with the first body 10. The fourth threaded portion 33 of the first drive member 30 is screwed into the first threaded portion 11 of the first body 10, such that the first drive member 30 is assembled with the first body 10. At this time, the first mounting portion 31 of the first drive member 30 protrudes from the first body 10, and the second mounting portion 32 is received in the receiving space 12. The second drive member 40 is received in the receiving space 12. The third mounting portion 42 is mounted on the second mounting portion 32 such that the second drive member 40 is mounted on the first drive member 30. The third drive member 50 is received in the receiving space 12 of the first body 10 and the first through hole 22 of the second body 20. The second resting portion 52 rests on the first resting portion 23, and the fifth mounting portion 53 of the third drive member 50 protrudes from the first through hole 22 of the second body 20. The fourth drive member 60 is received in the receiving space 12. The sixth mounting portion 61 is mounted on the fourth mounting portion 51 such that the fourth drive member 60 is mounted on the third drive member 50. The second receiving grooves 62 align with the first receiving grooves 41, and the second end face 63 faces the first end face 44. The elastic member 70 is biased elastically between the first drive member 30 and the second drive member 40. The elastic member 70 is compressed to set the rotation torque of the torque connector according to the compression degree. When the first mounting portion 31 is driven, the first drive member 30 drives the second drive member 40, the third drive member 50, and the fourth drive member 60. The fifth mounting portion 53 is mounted on a socket which is used to drive a workpiece, such as a screw member. The first received portion 81 of each of the pins 80 is received in each of the second receiving grooves 62, and the second received portion 82 of each of the pins 80 is received in each of the first receiving grooves 41.

Figure 5:
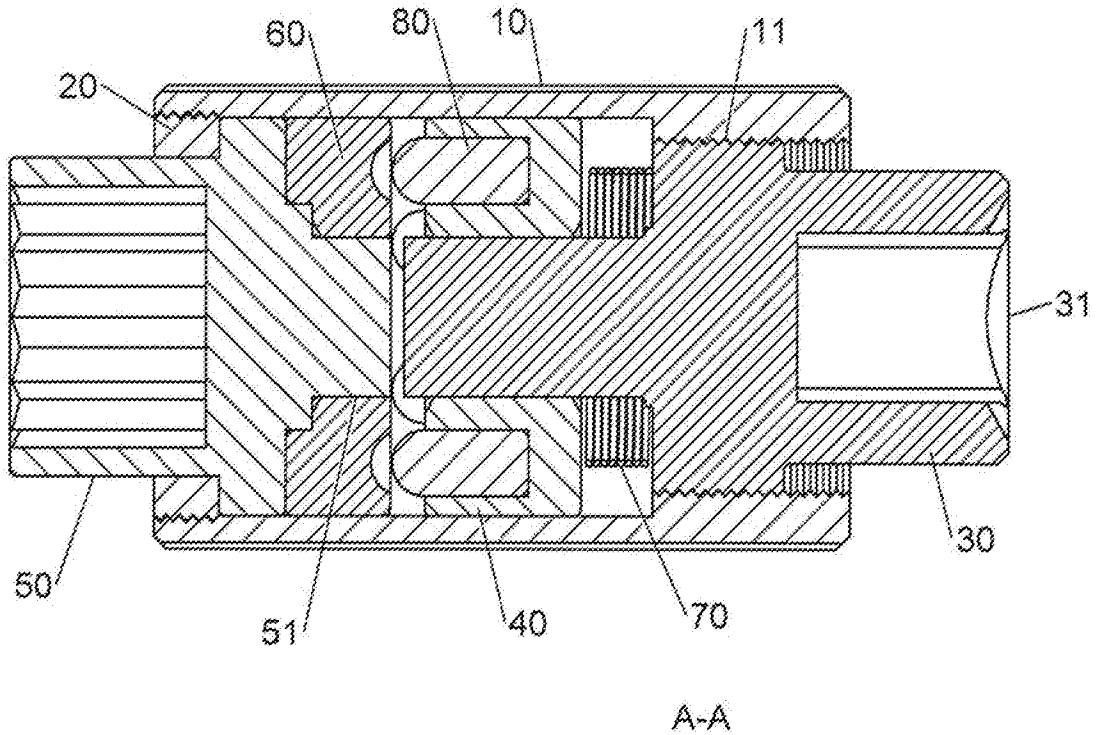
FIG. 5 is a schematic operational view of the torque connector structure as shown in FIG. 4 in use.

Referring to FIG. 5 with reference to FIGS. 1-4, after the screw member is driven by the fifth mounting portion 53 to reach a determined torque, the axial force applied on the second drive member 40 is more than the elastic force of the elastic member 70, such that the second drive member 40 is moved backward to further compress the elastic member 70, and the first received portion 81 of each of the pins 80 is detached from each of the second receiving grooves 62. Thus, the second drive member 40 cannot drive the third drive member 50 and the fourth drive member 60.

Figure 6:
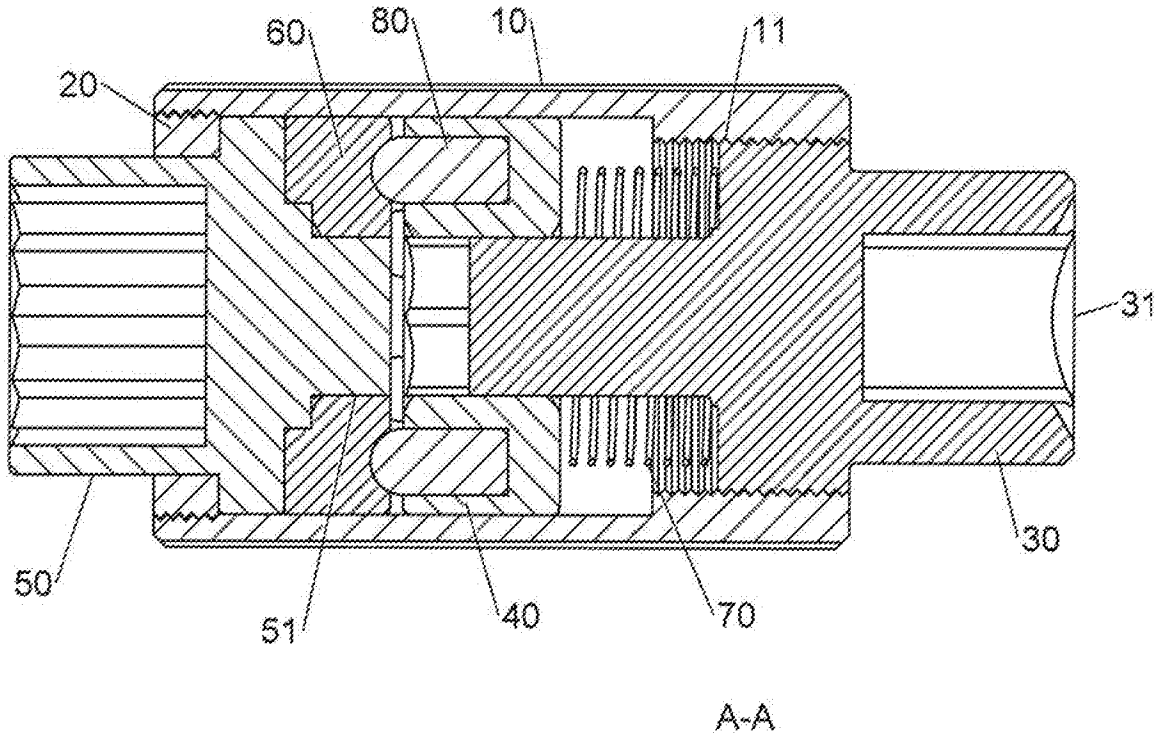
FIG. 6 is a schematic operational view of the torque connector structure as shown in FIG. 4 in adjustment.

Referring to FIG. 6 with reference to FIGS. 1-4, the relative position of the first body 10 and the first drive member 30 is adjusted to change the distance between the first drive member 30 and the second drive member 40, so as to regulate the compression degree of the elastic member 70, and to adjust the torque of the torque connector structure.

Figure 7:
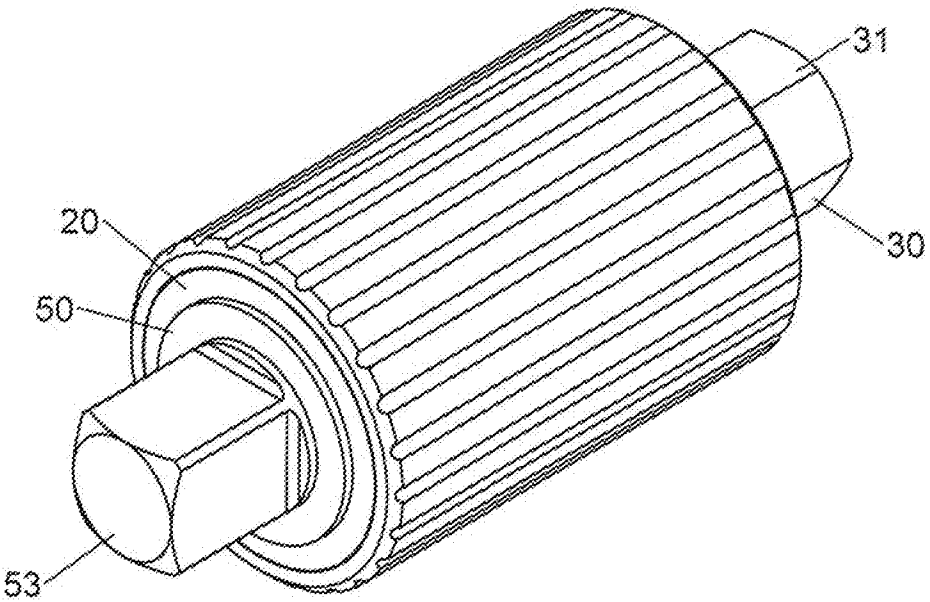
FIG. 7 is a perspective view of a torque connector structure in accordance with the second preferred embodiment of the present invention.

Referring to FIG. 7, the first mounting portion 31 of the first drive member 30 is a hexagonal head, and the fifth mounting portion 53 of the third drive member 50 is a square head.

Figure 8:
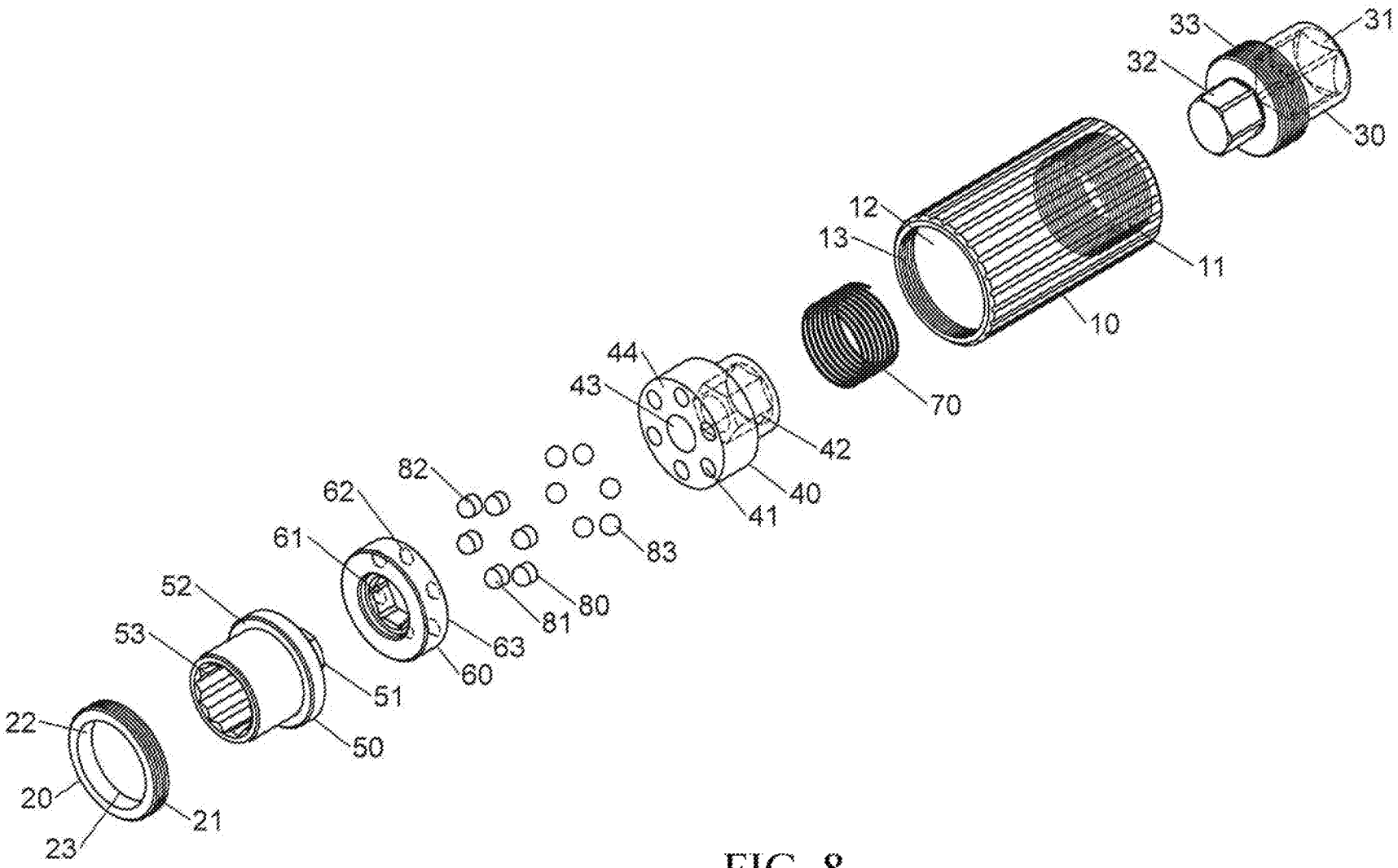
FIG. 8 is an exploded perspective view of a torque connector structure in accordance with the third preferred embodiment of the present invention.
Figure 9:
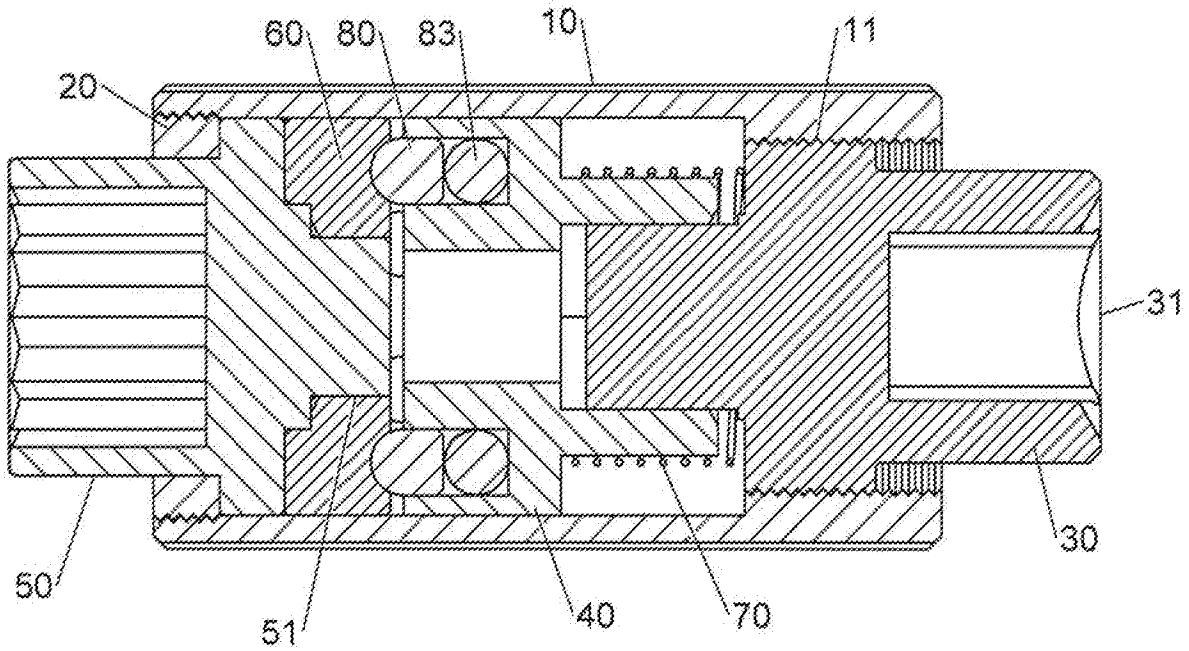
FIG. 9 is a cross-sectional view of the torque connector structure in accordance with the third preferred embodiment of the present invention.

Referring to FIGS. 8 and 9, the second drive member 40 is provided with a second through hole 43 connected to the third mounting portion 42. The second through hole 43 has a circular shape. The second received portion 82 of each of the pins 80 has a shorter length. The torque connector structure further comprises a plurality of balls 83. Each of the pins 80 and each of the balls 83 are received in each of the first receiving grooves 41 of the second drive member 40. Each of the balls 83 is arranged between each of the pins 80 and each of the first receiving grooves 41 of the second drive member 40.

Figure 10:
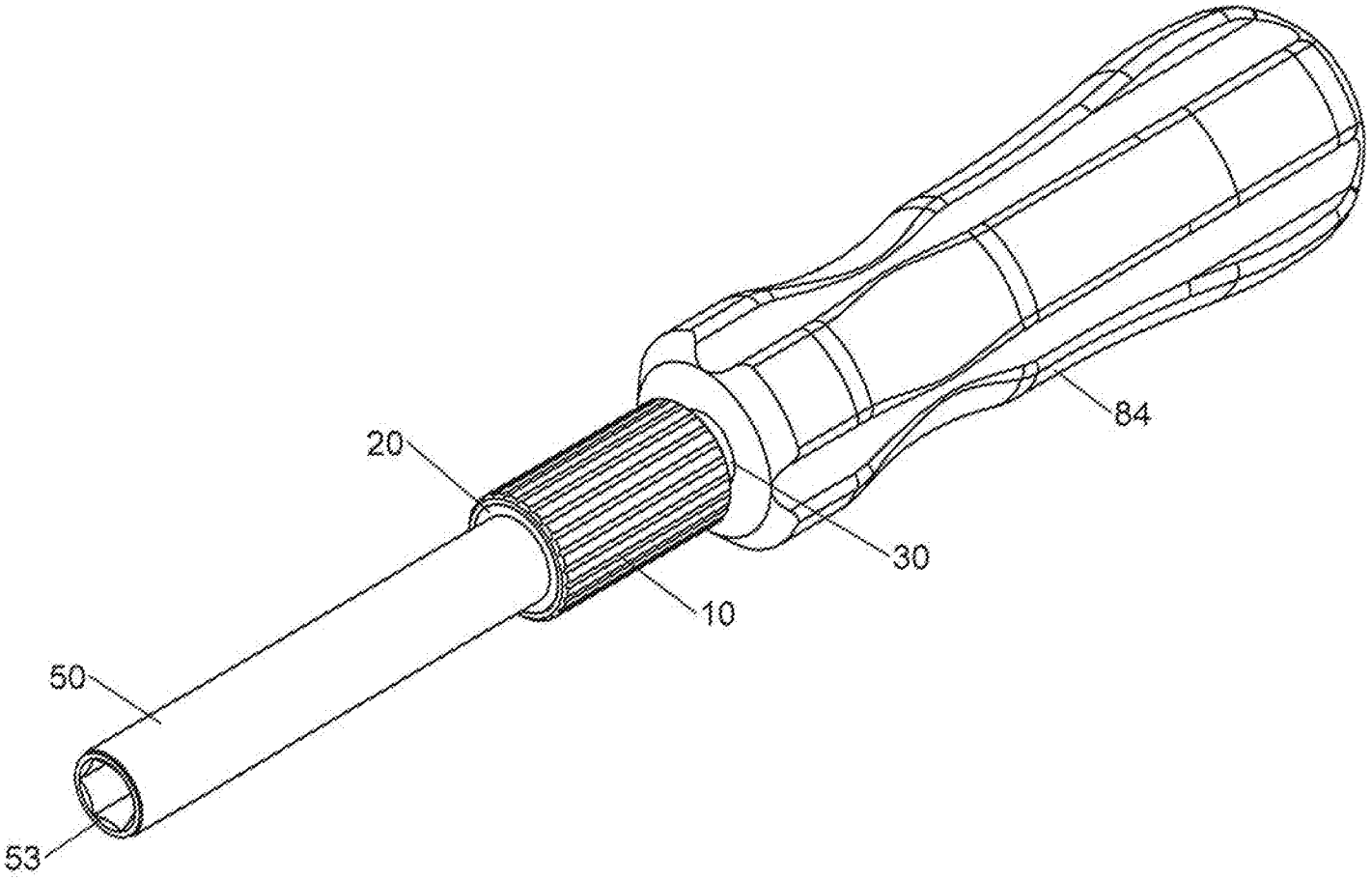
FIG. 10 is a perspective view of a torque connector structure in accordance with the fourth preferred embodiment of the present invention.

Referring to FIG. 10 with reference to FIGS. 1-4, the torque connector structure is available a screwdriver and comprises a handle 84 connected with the first mounting portion 31 of the first drive member 30. The fifth mounting portion 53 of the third drive member 50 is a hexagonal recess.

Figure 11:
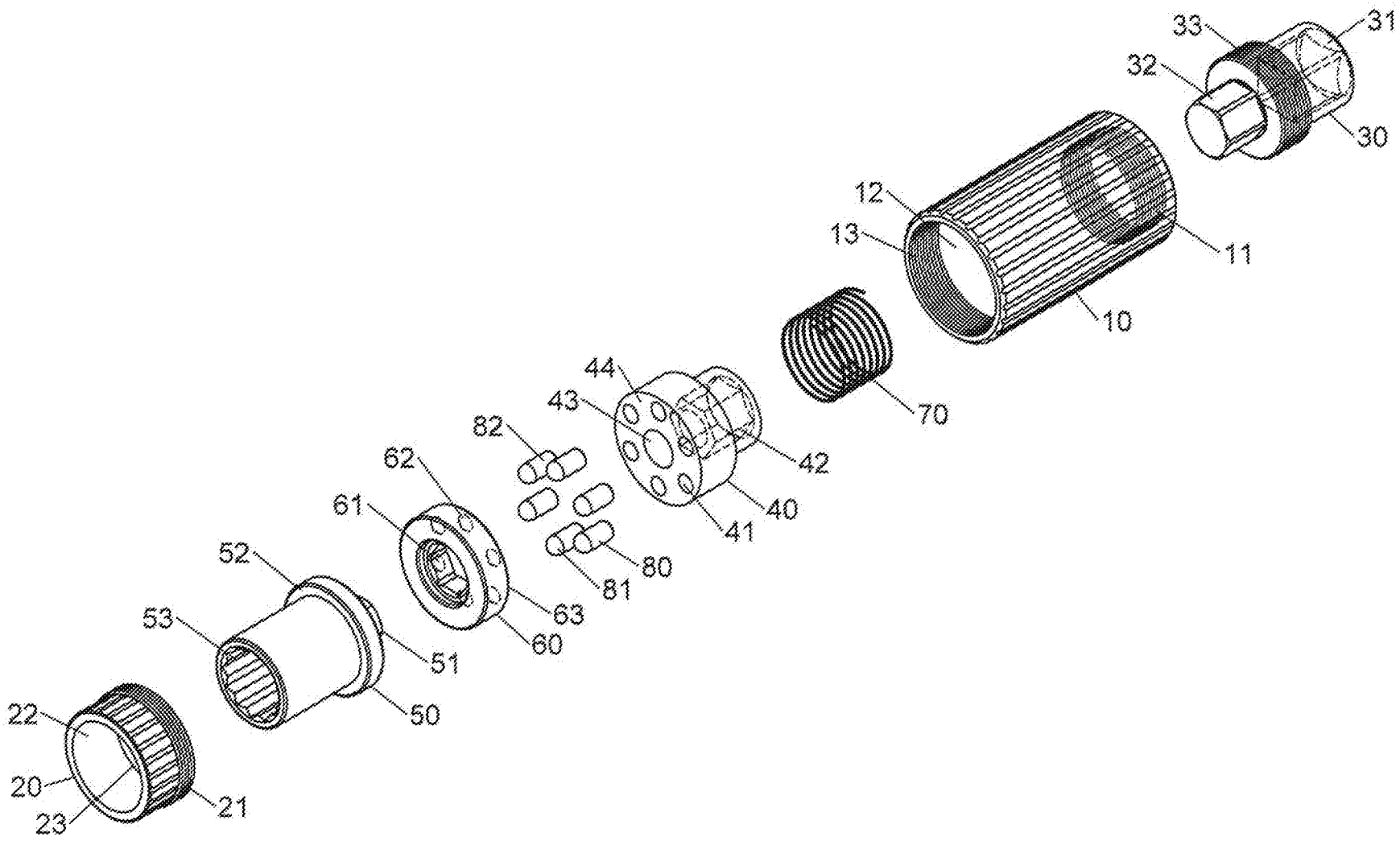
FIG. 11 is an exploded perspective view of a torque connector structure in accordance with the fifth preferred embodiment of the present invention.
Figure 13:
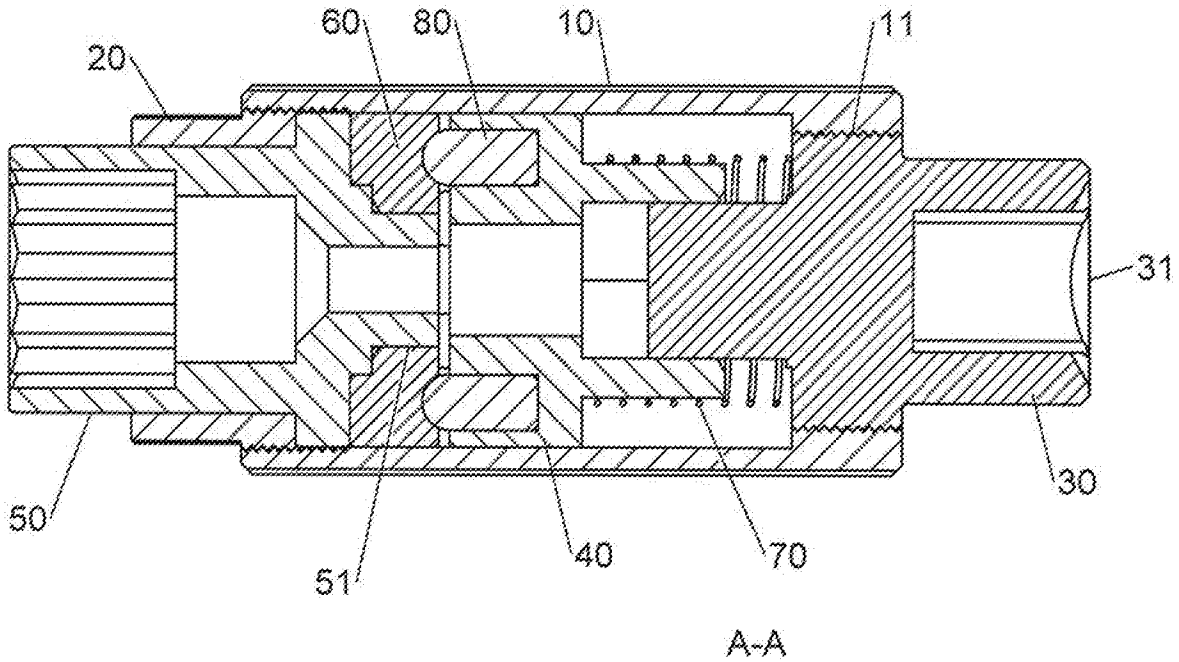
FIG. 13 is a cross-sectional view of the torque connector structure taken along line A-A as shown in FIG. 12.
Figure 12:
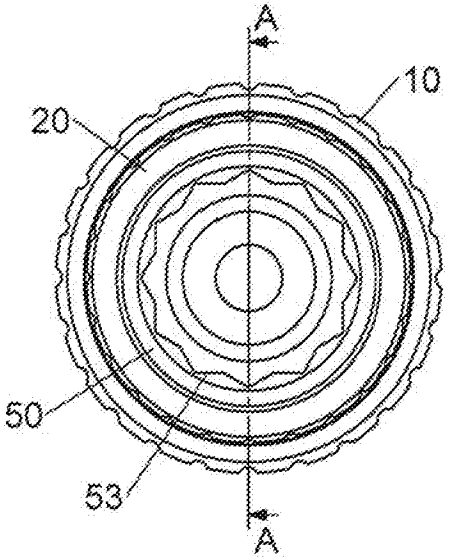
FIG. 12 is a front view of the torque connector structure in accordance with the fifth preferred embodiment of the present invention.

Referring to FIGS. 11-13, the second body 20 is screwed with the first body 10. The third threaded portion 21 of the second body 20 is screwed into the second threaded portion 13 of the first body 10. The second body 20 is rotated and moved in a range of the second threaded portion 13. The first drive member 30 is connected with the first body 10. Thus, the torque of the torque connector structure can also be adjusted.

Figure 14:
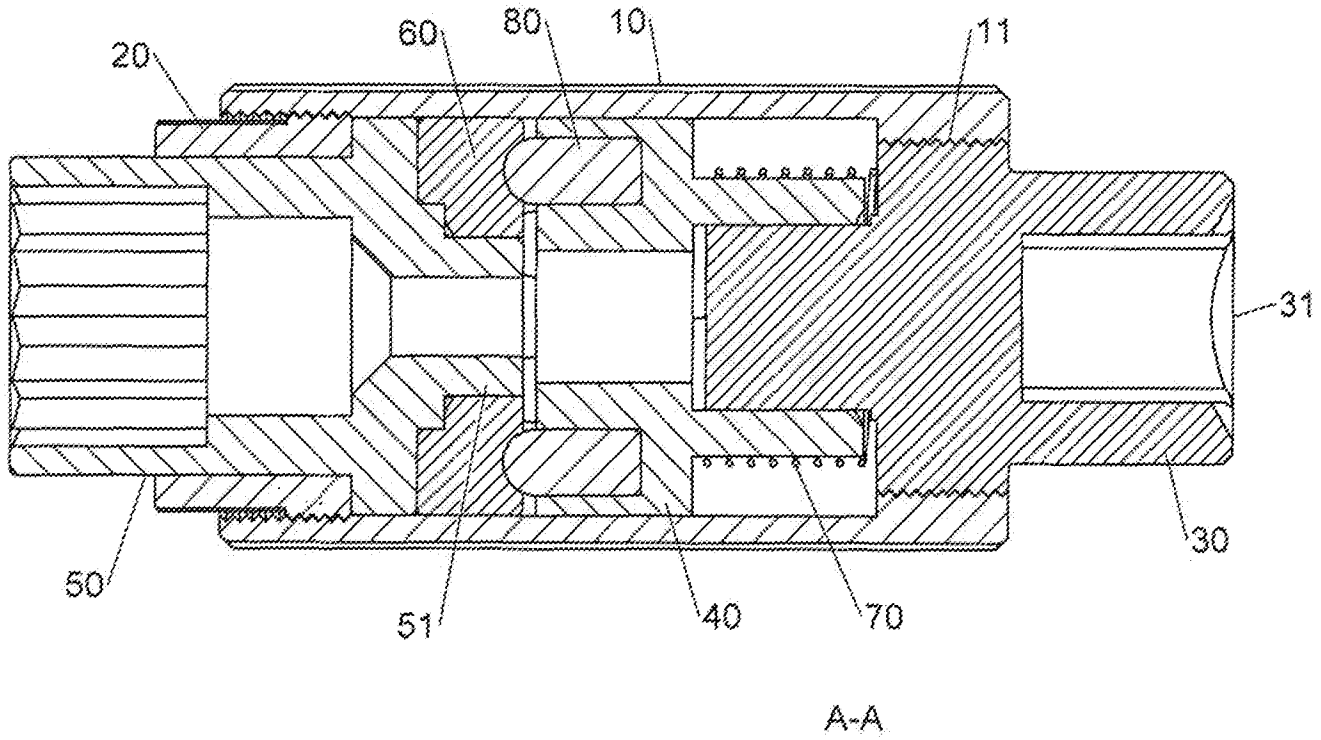
FIG. 14 is a schematic operational view of the torque connector structure as shown in FIG. 13 in adjustment.

Referring to FIG. 14 with reference to FIGS. 11-13, the first body 10 is rotated and moved relative to the second body 20 to change the distance between the first drive member 30 and the second drive member 40, so as to regulate the compression degree of the elastic member 70, and to adjust the torque of the torque connector structure.

In another preferred embodiment of the present invention, the first mounting portion 31 of the first drive member 30 is a hexagonal recess such that a hex wrench is connected with the first mounting portion 31 of the first drive member 30 to drive and rotate the first drive member 30.

In another preferred embodiment of the present invention, the third drive member 50 and the fourth drive member 60 are formed integrally. Thus, the fourth mounting portion 51 is undefined, and the third drive member 50 is directly provided with the second receiving grooves 62.

In another preferred embodiment of the present invention, when the screwing state between the first threaded portion 11 and the fourth threaded portion 33 is not adjustable or when the screwing state between the second threaded portion 13 and the third threaded portion 21 is not adjustable, the torque connector structure is under a state with a constant torque.

Accordingly, the torque connector structure has the following advantages.

1. Each of the pins 80 is provided with the first received portion 81 and the second received portion 82. The first received portion 81 is received in or detached from each of the second receiving grooves 62 by the compression degree of the elastic member 70. The second received portion 82 is received in each of the first receiving grooves 41. Each of the pins 80 has a cylindrical shape such that each of the pins 80 is received in each of the first receiving grooves 41 and will not drop from the second drive member 40. Thus, each of the pins 80 is assembled easily.

2. The second received portion 82 is received in each of the first receiving grooves 41. When the first mounting portion 31 of the first drive member 30 is driven, the first drive member 30 drives the second drive member 40, the third drive member 50, and the fourth drive member 60. The first received portion 81 of each of the pins 80 is received in each of the second receiving grooves 62. After the screw member is driven by the fifth mounting portion 53 to reach a determined torque, the axial force applied on the second drive member 40 is more than the elastic force of the elastic member 70, such that the second drive member 40 is moved backward to further compress the elastic member 70, and the first received portion 81 of each of the pins 80 is detached from each of the second receiving grooves 62.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque connector structure comprising:

a first body, a second body, a first drive member, a second drive member, a third drive member, a fourth drive member, an elastic member, and a plurality of pins;

wherein:

the first body has a first end provided with a first threaded portion and a second end provided with a second threaded portion;

the first threaded portion is an internal thread;

the second threaded portion is an internal thread;

the first body is provided with a receiving space;

the receiving space has a circular shape;

the second body is assembled with the first body;

the second body is provided with a third threaded portion screwed with the second threaded portion of the first body;

the third threaded portion is an external thread;

the second body is rotated and moved in a range of the second threaded portion;

the second body is provided with a first through hole;

the first through hole has a circular shape;

the second body has an end face provided with a first resting portion which is directed toward the receiving space;

the first drive member is assembled with the first body;

the first drive member has a first end provided with a first mounting portion and a second end provided with a second mounting portion;

the first mounting portion protrudes from the first body;

the second mounting portion has a noncircular shape and is received in the receiving space;

the first drive member is provided with a fourth threaded portion screwed with the first threaded portion;

the fourth threaded portion is an external thread and is located between the first mounting portion and the second mounting portion;

a relative position between the first drive member and the first body is adjustable axially in a range of the first threaded portion;

the second drive member is received in the receiving space;

the second drive member is mounted on the first drive member such that the second drive member and the first drive member are driven simultaneously;

a relative position between the second drive member and the first drive member is adjustable;

the second drive member is provided with a plurality of first receiving grooves;

each of the first receiving grooves has a cylindrical shape;

the second drive member is provided with a third mounting portion;

the third mounting portion is mounted on the second mounting portion which is slidable linearly in the third mounting portion;

the second drive member is provided with a first end face;

the first receiving grooves are formed in the first end face;

the third drive member is received in the receiving space of the first body and extends through the first through hole of the second body;

the third drive member has a first end provided with a fourth mounting portion and a second end provided with a fifth mounting portion;

the fifth mounting portion protrudes from the first through hole;

the third drive member is provided with a second resting portion abutting the first resting portion;

the fourth drive member is received in the receiving space and mounted on the third drive member;

the fourth drive member is provided with a sixth mounting portion mounted on the fourth mounting portion;

the fourth drive member is provided with a plurality of second receiving grooves;

the second receiving grooves align with the first receiving grooves;

each of the second receiving grooves has a semicircular shape;

the fourth drive member is provided with a second end face;

the second receiving grooves are formed in the second end face;

the second end face faces the first end face;

the elastic member is biased elastically between the first drive member and the second drive member to push the second drive member relative to the first drive member;

the elastic member has a first end pressing the first drive member and a second end pressing the second drive member;

each of the pins is received in each of the first receiving grooves and each of the second receiving grooves;

each of the pins has a first end provided with a first received portion and a second end provided with a second received portion;

the first received portion has a semicircular shape and is received in each of the second receiving grooves; and the second received portion has a cylindrical shape and is received in each of the first receiving grooves.

2. The torque connector structure as claimed in claim 1, wherein the first mounting portion is a tetragonal recess, a hexagonal head or a hexagonal recess, and the fifth mounting portion is a dodecagonal recess, a hexagonal recess, a tetragonal head or a hexagonal head.

3. The torque connector structure as claimed in claim 1, wherein the second mounting portion is a hexagonal head, the third mounting portion has a shape the same as that of the second mounting portion and is a hexagonal recess, the fourth mounting portion is a hexagonal head, and the sixth mounting portion is a hexagonal recess.

4. The torque connector structure as claimed in claim 1, wherein the second drive member is provided with three, six, nine or twelve first receiving grooves.

5. The torque connector structure as claimed in claim 1, wherein the second drive member is provided with a second through hole connected to the third mounting portion, and the second through hole has a circular shape.

6. The torque connector structure as claimed in claim 1, further comprising:

a plurality of balls;

wherein:

each of the pins and each of the balls are received in each of the first receiving grooves of the second drive member; and each of the balls is arranged between each of the pins and each of the first receiving grooves of the second drive member.

7. The torque connector structure as claimed in claim 1, wherein the fourth threaded portion of the first drive member has a diameter equal to that of the first threaded portion of the first body.

8. The torque connector structure as claimed in claim 1, wherein the first drive member is detached from the first body when the fourth threaded portion is disengaged from the first threaded portion.

9. The torque connector structure as claimed in claim 1, wherein the second body is detachably mounted on the third drive member.

10. The torque connector structure as claimed in claim 1, wherein the first through hole of the second body is detachably mounted on the fifth mounting portion of the third drive member.

11. The torque connector structure as claimed in claim 1, wherein the second body is rotatable relative to the third drive member.

12. The torque connector structure as claimed in claim 1, the third drive member is driven by the fourth drive member.

13. The torque connector structure as claimed in claim 1, wherein the fourth mounting portion of the third drive member is driven by the sixth mounting portion of the fourth drive member.

14. The torque connector structure as claimed in claim 1, wherein the fourth mounting portion of the third drive member is rotated with the sixth mounting portion of the fourth drive member, and the third drive member is rotated with the fourth drive member.

15. The torque connector structure as claimed in claim 1, wherein the sixth mounting portion is formed in an interior of the fourth drive member.

16. The torque connector structure as claimed in claim 1, wherein the elastic member is mounted on the second mounting portion of the first drive member.

17. The torque connector structure as claimed in claim 1, wherein the elastic member is compressed by the first drive member.

* * * * *